US006255770B1

(12) United States Patent
Murata

(10) Patent No.: US 6,255,770 B1
(45) Date of Patent: Jul. 3, 2001

(54) CORONA RESISTANT SADDLE-SHAPED DEFLECTION COIL

(75) Inventor: Akio Murata, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/295,387

(22) Filed: Apr. 21, 1999

(30) Foreign Application Priority Data

Apr. 28, 1998 (JP) ..... 10-119521

(51) Int. Cl.[7] ..... H01J 29/70

(52) U.S. Cl. ..... 313/440; 313/413; 313/421; 335/210; 335/211; 335/212; 335/213

(58) Field of Search ..... 313/440, 413, 313/421; 335/210, 211, 212, 213

(56) References Cited

U.S. PATENT DOCUMENTS 5,714,921 * 2/1998 Aoki ..... 335/213
5,811,915 * 9/1998 Abe et al. ..... 313/141

FOREIGN PATENT DOCUMENTS 57-34673 7/1982 (JP) ..... H01J/29/76
59-119640 7/1984 (JP) ..... H01J/9/236

* cited by examiner

*Primary Examiner*—Vip Patel
*Assistant Examiner*—Kevin Quarterman
(74) *Attorney, Agent, or Firm*—Ronald P. Kananen; Rader, Fishman & Grauer

(57) ABSTRACT

In a deflection yoke employing a saddle-shaped deflection coil of a bobbin-winding type, a fusion layer for fusing at least those wires of the coil disposed in proximity to each other is provided in each bent portion of the deflection yoke, whereby occurrence of corona at the bent portions can be effectively prevented.

15 Claims, 5 Drawing Sheets

CORONA RESISTANT SADDLE-SHAPED DEFLECTION COIL

BACKGROUND OF THE INVENTION

The present invention relates to a deflection yoke provided on a CRT (Cathode Ray Tube) such as a television set or computer display, and particularly to a deflection yoke including a bobbin having a shape suitable for forming a deflection coil into a saddle shape.

With the trend toward higher image qualities of television sets and the like, deflection yokes have been improved to perform double-speed deflection for realizing the higher image qualities.

In this case, as a result of doubling the deflection frequency, the inductance of a deflection coil is required to be reduced to a quarter and an applied current is required to be increased. This causes problems associated with power consumption of a TV circuit and heat generation of the deflection yoke.

To meet with the requirement to double the deflection frequency, there has been proposed a method of doubling a voltage of a horizontal deflection pulse.

In a usual TV set, the voltage of a horizontal deflection pulse is generally specified at 1.2 kV from the viewpoint of the withstand voltage of a transistor, and accordingly, the doubled voltage of a horizontal deflection pulse becomes 2.4 kV.

When the deflection frequency is doubled and the voltage of a horizontal deflection pulse is doubled, the inductance of the deflection coil may be equal to that specified in accordance with the NTSC form, and the current amount may be reduced to a half that required for the related art double-speed deflection, that is, may be equal to that specified in accordance with the NTSC form.

The increased voltage of a horizontal deflection pulse is effective to reduce the power consumption upon high speed scanning and to suppress an adverse effect of the winding accuracy exerted on image quality due to reduction in inductance.

When the doubled voltage is applied to the deflection coil as described above, however, there arises a problem that corona occurs among respective wires of the coil. Corona means firing discharge occurring before spark discharge, which results from partial dielectric breakdown caused at a portion where a surface electric field is locally large when electric fields of conductors are not equal to each other.

The occurrence of corona may cause layer short-circuit with elapsed time, which leads to a serious problem associated with fuming and firing.

A deflection yoke employing a saddle-shaped deflection coil is classified into a type in which the deflection coil is wound around a die (hereinafter, referred to as "a die-winding type"), and a type in which the deflection coil is wound around a bobbin (hereinafter, referred to as "a bobbin-winding type").

In the die-winding type, wire-winding is performed around the outer periphery of a die, followed by current-carrying, molding and cooling to form the coil shape. In this case, to mold the coil, the wires are bound by filling gaps among the wires with an insulating fusion agent (for example, Japanese Patent Laid-open No. Sho 59-119640 discloses a method of manufacturing a saddle-shaped deflection coil of a deflection yoke of a die-winding type).

In the bobbin-winding type, a saddle-shaped deflection coil is formed without molding the coil by winding wires on a bobbin along grooves or ribs previously provided in or on the bobbin.

The bobbin used for the bobbin-winding type is an integrally molded product from a heat-resisting synthetic region (i.e. an insulating) or the like. The bobbin has a main body portion, formed into an approximately horn-like shape, for covering the outer periphery of a cathode ray tube in a range from a funnel portion to a neck portion, and groove portions integrally formed at both end portions of the main body portion in the direction of the tube axis or Z-axis.

A main coil portion of the saddle-shaped deflection coil is wound on the main body portion of the bobbin in the direction of the tube axis of the cathode ray tube. To guide the winding of respective wires of the main coil portion, a plurality of ribs are formed on the inner surface of the main body portion in the direction of the tube axis.

The groove portions are formed at both the end portions of the main body portion in the direction of the tube axis into annular shapes centered on the tube axis. A bent portion of the saddle-shaped deflection coil is wound on each groove portion in the direction around the tube axis.

In such a bobbin-winding type, the coil can be wound around the bobbin, and therefore, it is not subjected to current-carrying and molding after winding.

In the above deflection yoke of the bobbin-winding type, occurrence of corona in the horizontal deflection coil has been prevented as follows. With respect to the main coil portion of the horizontal deflection coil, there has been adopted a method of restricting the positions of respective wires of the coil by, for example, forming slits or the like in the bobbin.

With respect to the bent portions of the horizontal deflection coil, there has been adopted a method of changing the thickness of each bent portion or tapering the thickness of the bent portion disposed on the front surface side of the cathode ray tube.

In addition, an example in which the bent portion is displaced in the direction of the tube axis has been disclosed, for example, in Japanese Utility Model Publication No. Sho 57-34673.

In the above method, however, there arises a problem that the overall length of the bobbin becomes longer. Also, when the thickness of the bent portion is thinned, there can be obtained an effect of preventing occurrence of corona; however, there arises a problem that the outer shape of the bent portion becomes larger. In addition, a method in which projections are provided in part of the groove portion has been disclosed; however, such a method is undesirable from the viewpoint of practical use.

More over in the bobbin-winding type, since the positions of the wires are not particularly restricted in the groove portion of the bobbin, there occurs disorder of the wires in the groove portion, with a result that gaps are formed between the wires.

By the formation of fine gaps between the wires in the groove portion of the bobbin, corona is liable to occur thereat as will be apparent on the basis of the principle to be described later, thereby making it impossible to increase a corona inception voltage.

SUMMARY OF THE INVENTION

An object of the present invention is to provide a deflection yoke employing a saddle-shaped deflection coil of a bobbin-winding type, which is capable of effectively preventing occurrence of corona.

To achieve the above object, according to the present invention, there is provided a deflection yoke including: a saddle-shaped deflection coil which is formed into a saddle-like shape by winding wires around a main body portion provided on a bobbin and around groove portions provided at both axial ends of the main body portion; wherein each of the bent portions formed by winding the wires around the groove portions has a fusion layer for fusing at least those of the wires disposed in proximity to each other.

The main coil portion of the saddle-shaped deflection coil is wound on the main body portion of the bobbin of the deflection yoke of the present invention substantially in the direction of the tube axis of the cathode ray tube, and the bent portions of the saddle-shaped deflection coil are wound on the groove portions of the bobbin in the direction around the tube axis.

The wires of the bent portion wound around the groove portion of the bobbin are arranged in the groove portion in such a manner as to be spaced from each other at various intervals thereamong, for example, due to disorder of the wires upon winding works.

According to the present invention, the fusion layer for fusing the wires to each other is provided in the bent portion, so that at least fine gaps between the wires are filled with the fusion layer, to thereby prevent occurrence of corona. With respect to large gaps between the wires, since corona is generally hard to occur at the large gaps, occurrence of corona can be prevented even in a state in which they are not filled with the fusion layer.

Accordingly, in the deflection yoke employing the saddle-shaped deflection coil of the bobbin-winding type, it is possible to effectively prevent occurrence of corona at the bent portions without changing the shapes of the bent portions, that is, without enlarging the size of the deflection coil.

DESCRIPTION OF THE PREFERRED EMBODIMENTS

Hereinafter, embodiments of a deflection yoke of the present invention will be described with reference to the accompanying drawings.

Figure 1:
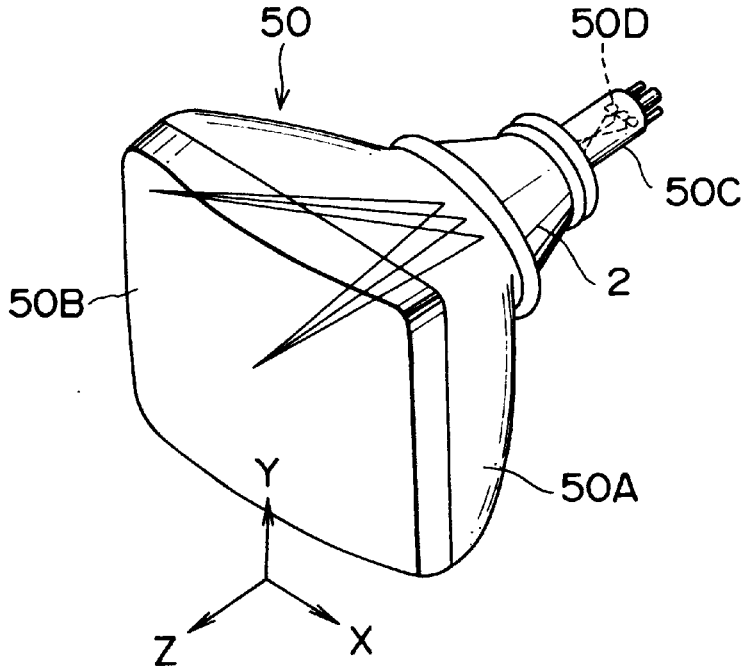
FIG. 1 is a perspective view of a cathode ray tube provided with a deflection yoke of the present invention.
Figure 2:
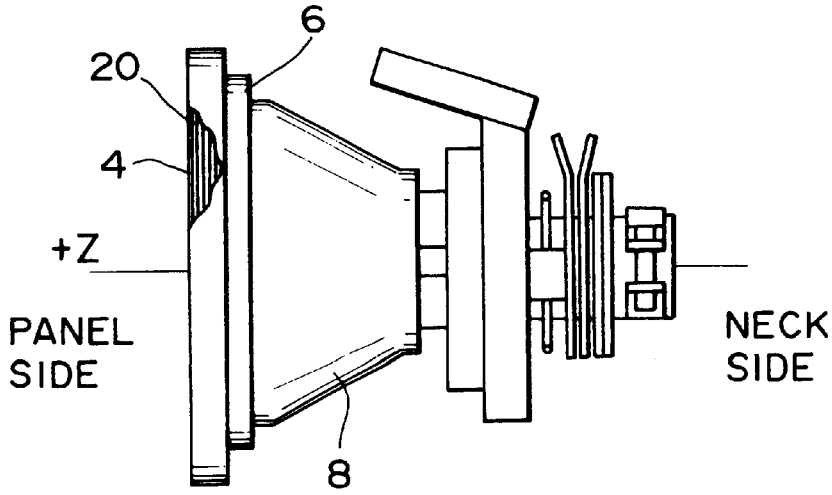
FIG. 2 is a side view, with parts partially cutaway, showing the deflection yoke of the present invention.

FIG. 1 is a perspective view of a cathode ray tube in which a deflection yoke of the present invention is provided, and FIG. 2 is a side view, with parts partially cutaway, showing the deflection yoke of the present invention.

Referring to FIG. 1, there is shown a cathode ray tube 50 including a funnel portion 50A; a panel portion 50B having a fluorescent screen and located in front of the funnel portion 50A; and a neck portion 50C containing an electron gun 50D and located at the back of the funnel portion 50A. A deflection yoke 2 is provided around the outer periphery of an intermediate portion between the funnel portion 50A and neck portion 50C.

As shown in FIG. 2, the deflection yoke 2 includes a saddle-shaped horizontal deflection coil 4 disposed inside a bobbin 20; a saddle-shaped vertical deflection coil 6 and a DY core 8 disposed outside the bobbin 20; and a magnet for purity adjustment, a magnet for convergence adjustment, a mounting fixture, and the like disposed at the back of the bobbin 20.

Figure 3A:
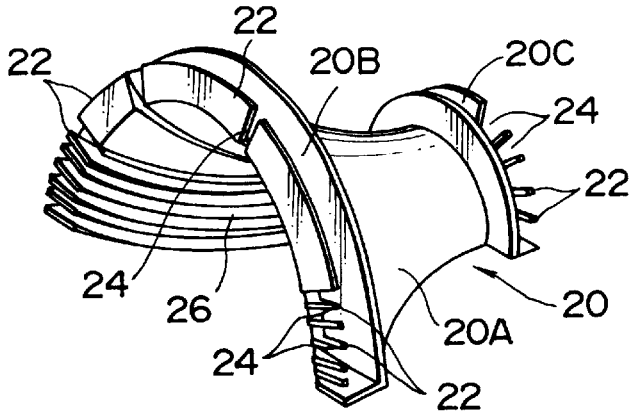
FIG. 3A is a perspective view showing the shape of a bobbin of the deflection yoke.
Figure 3B:
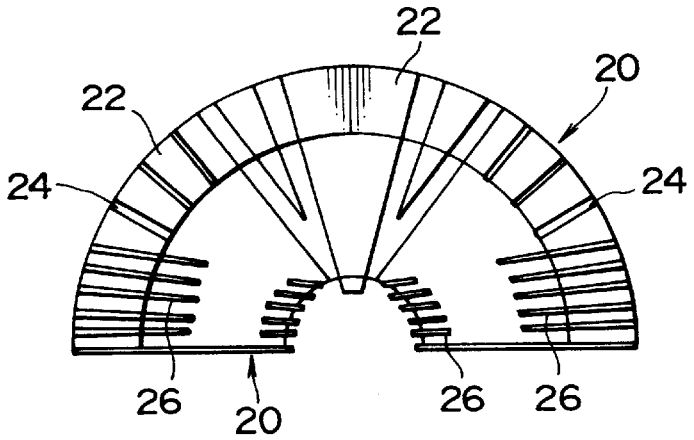
FIG. 3B is a view, seen from the panel side, of the bobbin of the deflection yoke.
Figure 3C:
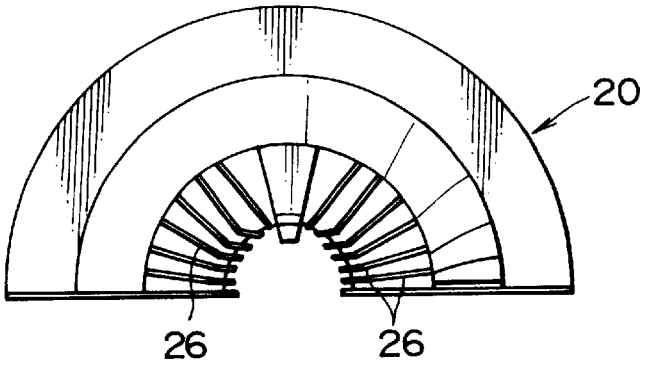
FIG. 3C is a view, seen from the neck side, of the bobbin of the deflection yoke.

FIG. 3A is a perspective view showing the shape of the bobbin 20 of the deflection yoke of the present invention; FIG. 3B is a view, seen from the panel side, of the bobbin 20 of the deflection yoke of the present invention; and FIG. 3C is a view, seen from the neck side, of the bobbin 20 of the deflection yoke of the present invention.

Figure 4A:
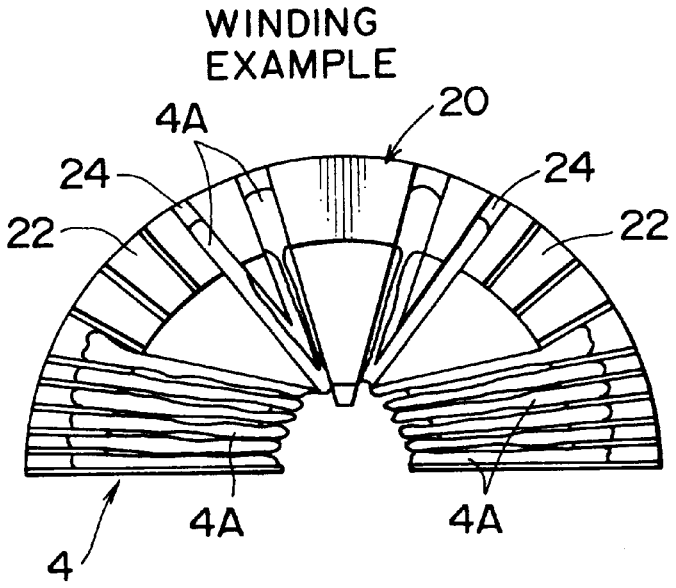
FIG. 4A is a view, seen from the panel side, of a winding example of a horizontal deflection coil around the bobbin.
Figure 4B:
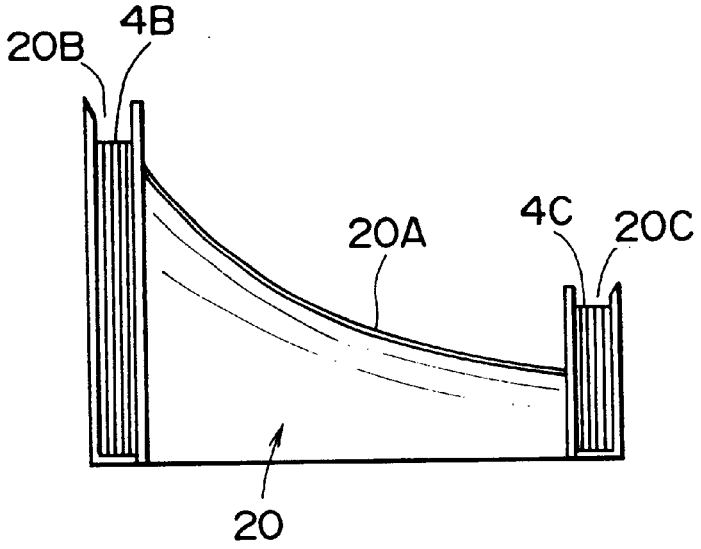
FIG. 4B is a side view showing the winding example of the horizontal deflection yoke around the bobbin.

FIG. 4A is a view, seen from the panel side, of a winding example of a horizontal deflection coil 4 around the bobbin 20, and FIG. 4B is a side view showing a winding example of the horizontal deflection coil 4 around the bobbin 20.

The bobbin 20 functions as separator for separating/insulating the horizontal deflection coil 4 from the vertical deflection coil 6. The bobbin 20 is formed into an approximately horn-like shape corresponding to the outer peripheral shape of the cathode ray tube 50, concretely, having a wide opening on the front side and a narrow opening on the rear surface side. In FIGS. 3A to 3C and FIGS. 4A and 4B, the shape of the upper half of the bobbin 20 is shown.

The bobbin 20 is formed by integrally molding two groove portions 20B and 20C disposed at the front and rear opening portions, and a main body portion 20A connecting the groove portions 20B and 20C to each other. Flanges formed into annular shapes centered on the tube axis Z are formed on both sides of each of the groove portions 20B and 20C. A main coil portion 4A of the horizontal deflection coil 4 is wound on the inner surface of the main body portion 20A in the direction of the tube axis Z, and bent portions 4B and 4C of the horizontal deflection coil 4 are wound on the groove portions 20B and 20C in the direction around the tube axis Z, respectively.

A plurality of sections 22 and winding grooves 24 are provided on and in each front flange of the groove portion 20B and the rear flange of the groove portion 20C, and a large number of ribs 26 are provided on the inner peripheral surface of the main body portion 20A. The horizontal deflection coil 4 is wound while being guided by these sections 22, winding grooves 24, and the ribs 26.

Figure 5:
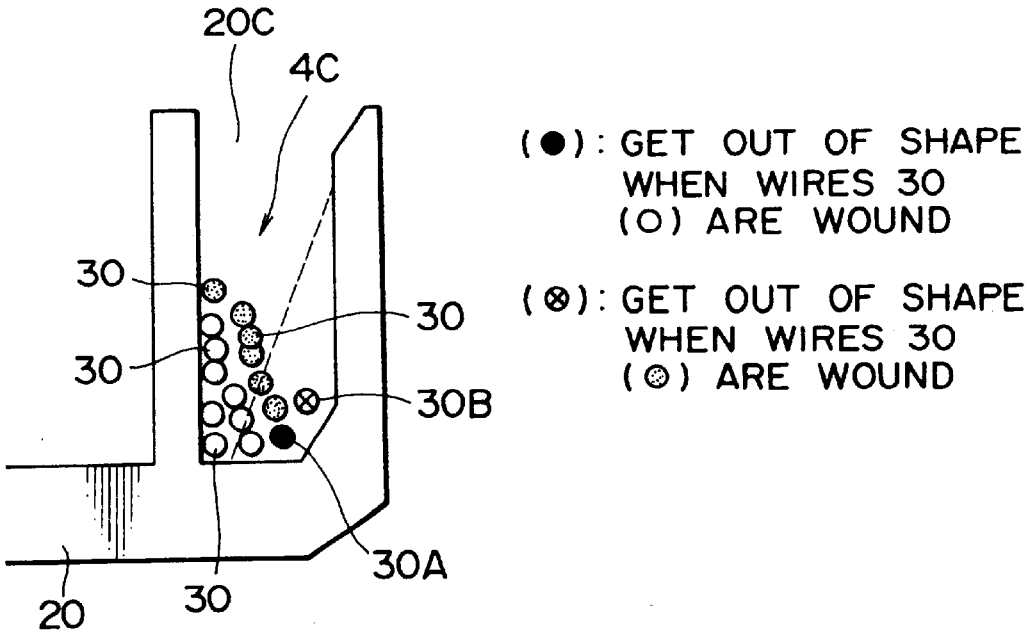
FIG. 5 is a sectional view, on the enlarged scale, showing a state of wires of the horizontal deflection coil in a groove portion of the deflection yoke.

FIG. 5 is a sectional view, on an enlarged scale, showing a state of wires of the horizontal deflection coil 4 in the groove portion 20C.

As shown in the figure, among wires 30 wound around the groove portion 20C, wires 30A and 30B get out of shape during winding operations, and the remaining wires 30 are spaced from each other at random intervals by disorder of the wires caused during winding operations.

When a high voltage is applied among the wires 30, 30A and 30B, corona occurs depending on a gap between two adjacent ones of the wires, and particularly, a large differential potential between the two adjacent ones of the wires 30A and 30B having been out of the shapes.

Hereinafter, the generation principle of corona between wires will be described.

Figure 6:
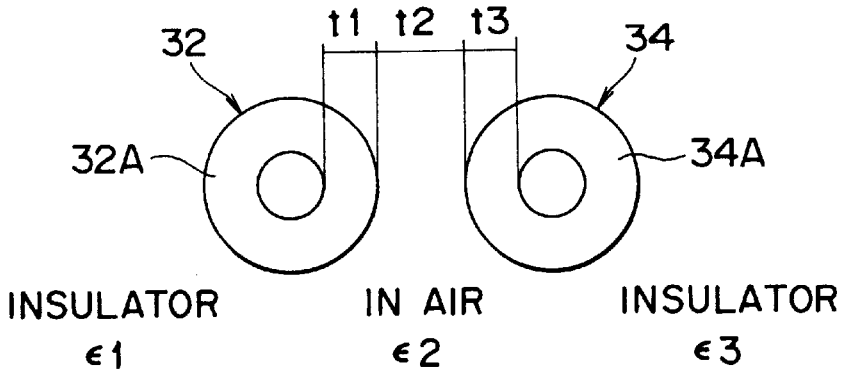
FIG. 6 is a sectional view, on an enlarged scale, showing an arrangement relationship between two wires of the deflection coil.

FIG. 6 is a sectional view, on an enlarged scale, showing an arrangement relationship between two wires.

As shown in the figure, letting $\in 1$ and $\in 3$ be dielectric constants of insulating films 32A and 34A of wires 32 and 34 and t1 and t3 be the thicknesses of the insulating films 32A and 34A respectively, and letting $\in 2$ be a dielectric constant in air and t2 be the gap between the insulating films 32A and 34A, an equivalent insulator thickness T is expressed by the following equation:

$$T=t1/\in 1+t2/\in 2+t3/\in 3$$

A corona inception voltage can be calculated on the basis of the equivalent insulator thickness T.

A method of calculating the corona inception voltage on the basis of the equivalent insulator thickness T will be described. For example, the corona inception voltage for a round conductor (copper wire) shown in FIG. 6 can be calculated by making use of a calculation equation having been prepared for a flat conductor. Further, the corona inception voltage can be calculated using a list on which calculated values of the corona inception voltage have been previously plotted with respect to the equivalent insulator thickness T.

As the equivalent insulator thickness becomes larger, the corona inception voltage can be increased. To be more specific, in the example shown in FIG. 6, the corona inception voltage can be increased by making larger the gap between the wires 32 and 34.

Alternatively, the corona inception voltage can be increased by making small the dielectric constants.

On the other hand, the material of an insulating film for the wires of the coil is generally specified depending on the insulating property required for the wires. For example, a urethane wire is covered with a synthetic film of polyurethane and polyamide, and a fusion wire is covered with a synthetic film of polyester imide and polyamide. Therefore, the dielectric constants of the insulating films are previously determined.

Figure 7A:
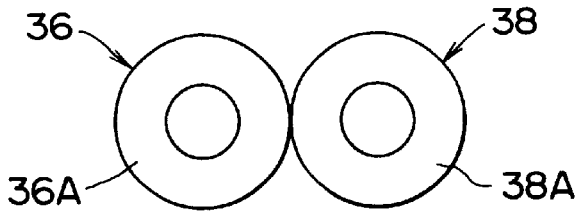
FIG. 7A is a sectional view, on the enlarged scale, showing a state in which two wires with a differential potential applied therebetween are adjacent to each other.
Figure 7B:
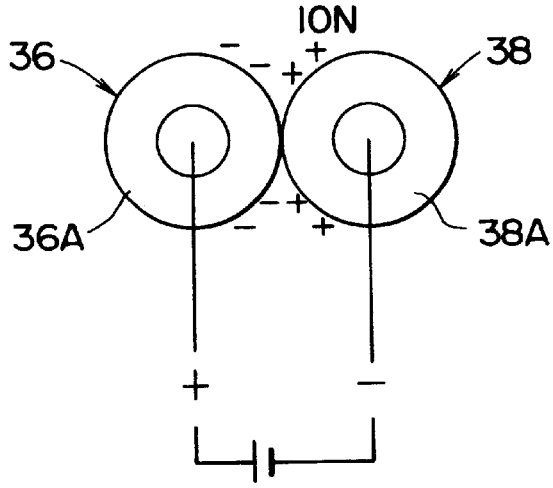
FIG. 7B is a sectional view, on the enlarged scale, showing a state in which ions are produced on insulating films of two wires due to the potential difference applied therebetween.

FIG. 7A is a sectional view, on an enlarged scale, showing a state in which two wires 36 and 38 with a differential potential applied therebetween are adjacent to each other, and FIG. 7B is a sectional view, on an enlarged scale, showing a state in which minus ions and plus ions are generated on insulating films 36A and 38A due to the differential potential applied between the two wires 36 and 38.

In this case, the wires 36 and 38 are in contact with each other. When a plus voltage is applied to the left wire 36 and a minus voltage is applied to the right wire 38, ions are migrated in air (gas), and ions with reversed polarities are collected on the insulating films 36A and 38A. As the ions with reversed polarities are increasingly accumulated on the surfaces of the insulating films 36A and 38A, corona discharge occurs. In addition, ions are not generated on the contact portion because such a portion is the lack of air (gas).

Figure 8:
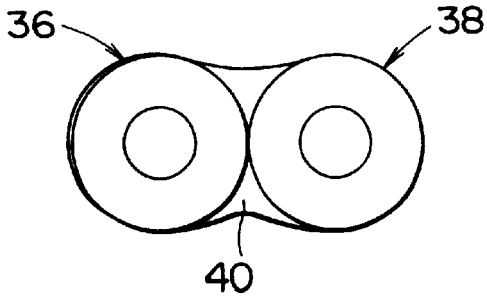
FIG. 8 is a sectional view, on an enlarged scale, showing a state in which a thermal fusion layer is provided between wires of the deflection coil.

As is apparent from the above description, the migration of ions is prevented by covering the wires 36 and 38 with an insulator, to eliminate a portion being significantly high in electric field, thereby increasing the corona inception voltage Vc. Accordingly, as shown in FIG. 8, by providing a thermal fusion layer 40 for fusing a portion between the wires 36 and 38, the gap between the wires 36 and 38 is filled with the insulator, thereby making it possible to increase the corona inception voltage Vc.

Next, a method of providing the thermal fusion layer 40 will be concretely described.

For example, the thermal fusion layer 40 can be formed by previously covering the outer periphery of the wires of the deflection coil with a fusion film made from a thermal fusion material, winding the wires, and heating the wires so as to fuse the thermal fusion material.

In this case, polyamide is preferably used for the thermal fusion material; however, any material may be used insofar as it is insulating and thermally fusible.

The insulating film of the above thermal fusion wire may be partially fused. In this case, the thickness of the insulating film may be set at a sufficiently large value. Further, in place of the method of previously providing the fusion film around the wires, a thermal fusion agent may be impregnated in the bent portion of the coil during winding operations.

In the case where the gap between the adjacent wires is sufficiently large, the migration of ions is unlikely to occur and thereby there is a small possibility that corona occurs, with a result that the corona is not required to be in the gap between the wires filled with the thermal fusion layer 40.

Accordingly, it is basically desirable to perfectly fill the gaps between the wires with an epoxy resin material as in a flyback transformer; however, in the deflection yoke of this type, since the voltage is lower than that of the flyback transformer, it is sufficient for the gaps between the adjacent wires to be filled with the material. Therefore, the sufficient effect can be obtained by fusion, for example, in accordance with the alcohol fusion manner.

The heating may be performed by applying a current to the saddle-shaped deflection coil after winding, to thereby self-fuse the wires. Alternatively, the fusion may be performed by applying a high frequency magnetic field, to fuse the wires with heat caused by eddy current generated in the copper wires.

Further, the wires can be self-fused by heating the saddle-shaped deflection coil from outside. This heating may be performed by a heater or using a hot wind.

As a result of the above-described saddle-shaped horizontal deflection coil with bent portions having wires with certain fusion structure, the horizontal deflection coil can withstand a differential potential of a horizontal deflection pulse applied across the horizontal deflection coil of 1.5 kV or more.

While the preferred embodiments of the present invention have been described using the specific terms, such description is for illustrative purposes only, and it is to be understood that changes and variations may be made without departing from the spirit or scope of the following claims.

What is claimed is:

1. A deflection yoke comprising:

a saddle-shaped deflection coil which is formed into a saddle-like shape by winding wires around a main body portion provided on a bobbin with bent portions around groove portions provided at both axial ends of said main body portion;

wherein each of the bent portions formed by winding said wires around said groove portions has a fusion layer for fusing at least those of said wires disposed in proximity to each other.

2. A deflection yoke according to claim 1, wherein said wires of said saddle-shaped deflection coil each have an insulating film made from a fusible material.

3. A deflection yoke according to claim 1, wherein said fusion layer is a coating made from a fusible material around the outer periphery of an insulating film of each of said wires of said saddle-shaped deflection coil.

4. A deflection yoke according to claim 1, wherein said fusion layer is an insulating fusible agent among said wires.

5. A deflection yoke according to claim 1, wherein said fusion layer is formed by self-fusing said wires by applying a current to said saddle-shaped deflection coil.

6. A deflection yoke according to claim 1, wherein said fusion layer is formed by self-fusing said wires by heating said saddle-shaped deflection coil from outside.

7. A deflection yoke according to claim 1, wherein said saddle-shaped deflection coil is a horizontal deflection coil for deflecting an electron beam emitted from a cathode ray tube in the horizontal direction.

8. A deflection yoke according to claim 1, wherein said saddle-shaped deflection coil is a horizontal deflection coil, and a differential potential of a horizontal deflection pulse applied across said horizontal deflection coil is 1.5 kV or more.

9. A deflection yoke according to claim 1, wherein said saddle-shaped deflection coil is a horizontal deflection coil, and a deflection yoke core and a vertical deflection coil are arranged around the outer periphery of said bobbin on the inner surface of which said horizontal deflection coil has been wound.

10. The method of forming a fusion layer in a deflection yoke comprising:

providing a generally saddle-shaped deflection coil with bent wire portions at the axial ends of said coil, the reference axis conforming to that of a CRT for which said coil is intended, and providing a fusion layer for at least said bent wire portions and, in turn, for at least those wires disposed in proximity to each other.

11. The method of claim 10 wherein said bent wire portions are provided an insulating film made from a fusible material.

12. The method of claim 10 wherein said bent wire portions are provided with a coating made from a fusible material around the outer periphery of an insulating film.

13. The method of claim 10 wherein said fusion layer is formed by impregnating an insulating fusible agent at least among said bent wires.

14. The method of claim 10 wherein said fusion layer is formed by self-fusing by applying a current to said deflection coil.

15. The method of claim 10 wherein said fusion layer is formed by self-fusing by heating said deflection coil from the outside.

* * * * *